US006174159B1

(12) United States Patent
Smith et al.

(10) Patent No.: US 6,174,159 B1
(45) Date of Patent: Jan. 16, 2001

(54) METHOD AND APPARATUS FOR A CATALYTIC FIREBOX REACTOR

(75) Inventors: Lance L. Smith, North Haven; Shahrokh Etemad, Trumbull; Hasan Ulkarim, Hamden; Marco J. Castaldi, Bridgeport; William C. Pfefferle, Madison, all of CT (US)

(73) Assignee: Precision Combustion, Inc., New Haven, CT (US)

( * ) Notice: Under 35 U.S.C. 154(b), the term of this patent shall be extended for 0 days.

(21) Appl. No.: 09/272,395

(22) Filed: Mar. 18, 1999

(51) Int. Cl.[7] ..... F23D 14/18

(52) U.S. Cl. ..... 431/7; 431/170; 431/326; 431/353

(58) Field of Search ..... 431/7, 170, 326, 431/328, 353; 60/299, 301, 723; 422/220, 196, 197, 222, 176; 502/527.19, 527.11, 527.24, 527.21

(56) References Cited

U.S. PATENT DOCUMENTS

| | | | | |
|---|---|---|---|---|
| 1,059,584 | * | 4/1913 | Winand . | |
| 2,805,229 | * | 9/1957 | Metzger . | |
| 3,489,208 | * | 1/1970 | Manteufel . | |
| 4,303,618 | * | 12/1981 | Fukui et al. | 422/197 |
| 4,305,910 | * | 12/1981 | Kudo et al. | 422/179 |
| 4,797,137 | * | 1/1989 | Sutton | 422/180 |
| 4,870,824 | | 10/1989 | Young et al. . | |
| 5,183,401 | | 2/1993 | Dalla Betta et al. . | |
| 5,202,303 | | 4/1993 | Retallick et al. . | |
| 5,250,489 | | 10/1993 | Dalla Betta et al. . | |
| 5,326,252 | * | 7/1994 | Tonon | 431/353 |
| 5,425,632 | | 6/1995 | Kazunori et al. . | |
| 5,512,250 | | 4/1996 | Dalla Betta et al. . | |
| 5,518,697 | | 5/1996 | Dalla Betta et al. . | |
| 5,577,906 | * | 11/1996 | Hanakata et al. | 431/268 |
| 5,916,128 | * | 6/1999 | Gar et al. | 60/274 |

FOREIGN PATENT DOCUMENTS

| | | | | |
|---|---|---|---|---|
| 0 559 808 B1 | | 1/1997 | (EP) . | |
| 0 559 844 B1 | | 2/1999 | (EP) . | |
| 61-259013 | * | 11/1986 | (JP) | 431/7 |
| 7-256115 | * | 10/1995 | (JP) | 431/326 |
| 9-210319 | * | 8/1997 | (JP) | 431/326 |
| 9-217905 | * | 8/1997 | (JP) | 431/326 |

OTHER PUBLICATIONS

Abstract, 59136140 JP A1, Aug. 4, 1984, Japan.
Abstract, 61259013 JP A1, Nov. 17, 1986, Japan.

* cited by examiner

*Primary Examiner*—Carl D. Price
(74) *Attorney, Agent, or Firm*—McCormick, Paulding & Huber LLP

(57) ABSTRACT

A catalytic firebox reactor employing an exothermic catalytic reaction channel and multiple cooling conduits for creating a partially reacted fuel/oxidant mixture. An oxidation catalyst is deposited on the walls forming the boundary between the multiple cooling conduits and the exothermic catalytic reaction channel, on the side of the walls facing the exothermic catalytic reaction channel. This configuration allows the oxidation catalyst to be backside cooled by any fluid passing through the cooling conduits. The heat of reaction is added to both the fluid in the exothermic catalytic reaction channel and the fluid passing through the cooling conduits. After discharge of the fluids from the exothermic catalytic reaction channel, the fluids mix to create a single combined flow. A further innovation in the reactor incorporates geometric changes in the exothermic catalytic reaction channel to provide streamwise variation of the velocity of the fluids in the reactor.

22 Claims, 4 Drawing Sheets

METHOD AND APPARATUS FOR A CATALYTIC FIREBOX REACTOR

This invention was made with government support under DE-FG02-95ER82054 awarded by the U.S. Department of Energy. The U.S. government has certain rights in this invention.

BACKGROUND OF THE INVENTION

1. Field of the Invention

The present invention relates to catalytic reactor design. More specifically, the invention is a catalytic reactor for converting a fuel/oxidant mixture into a fuel/oxidant/product mixture and heat. The reactor employs an exothermic catalytic reaction channel cooled by numerous cooling channels, where the cooling fluid is a portion of the ultimate fuel/oxidant/product mixture. A further refinement in the invention incorporates geometric changes in the exothermic and/or cooling portions of the reactor to provide streamwise variation of the velocity of the fluids in the reactor.

2. Brief Description of the Related Art

Highly exothermic catalytic reactors with internal cooling are well known. While they have varying applications, the reactors are typified by exothermic reactions within the catalytic portion of the reactor and a cooling means to control the temperature within the catalytic portion to avoid a material failure, either of the substrate or the catalyst. Cooling in these reactors can be accomplished by a number of means, including placing the catalyst in a backside-cooled relationship with the cooling agent. A backside-cooling arrangement is particularly suitable for catalytic reactions that are both rapid and highly exothermic, such as catalytic combustion. In this arrangement, the catalyst substrate (typically a metal foil) is coated with an oxidation catalyst on only one side, the opposite side (or backside) remaining free of oxidation catalyst. The substrate is shaped and assembled, before or after catalyst coating, to create separate channels for exothermic reaction (in the channels coated with oxidation catalyst) or for cooling (in the channels free of oxidation catalyst). Fluid passing through the cooling channels removes a portion of the heat generated in the exothermic reaction channels.

An early example of a backside-cooled catalytic reactor for use in a catalytic combustion system is presented in U.S. Pat. No. 4,870,824 to Young et al. The ë824 patent teaches the basic method of splitting a given fuel/air mixture flow into catalytic and non-catalytic passages. The '824 patent teaches the use of a ceramic substrate with multiple parallel channels, generally of the same shape and size, in which the walls which border and define each catalytic channel are coated with an oxidation catalyst on the sides facing the catalytic channel, but are not coated with an oxidation catalyst on the sides facing adjacent non-catalytic channels. By this method, the percentage of total reactants catalyzed in the reactor is no greater than the percentage of catalytic channels. The average temperature rise through the reactor is thus limited. In addition, the wall temperatures of catalytic channels bordering adjacent non-catalytic channels are controlled through the use of backside cooling.

Refinements of the basic structure taught by Young et al. are shown in U.S. Pat. Nos. 5,250,489 and 5,512,250 to Dalla Betta et al. In the '489 patent a metal substrate is used for improved heat conduction to the backside cooling fluid, and for greater resistance to thermal shock. Aluminum-containing steels are cited as being preferred. The '489 patent also teaches the use of non-similar shape and/or size channels, so that the flow split between catalytic and non-catalytic channels can be varied while retaining approximately half catalytic channels and half non-catalytic channels. Despite these changes, the fundamental structure claimed by Young et al., namely a multitude of catalytic channels and adjacent non-catalytic channels, is retained.

The '250 patent further refines the structure claimed by the '824 and '489 patents. In the '250 patent, Dalla Betta et al. teach a structure in which periodic alterations in channel shape provide different wall heat transfer rates in the catalytic channels and non-catalytic channels. Again, however, the fundamental structure claimed by Young et al., namely a multitude of catalytic channels and adjacent non-catalytic channels, is retained. Furthermore, while the '489 and '250 patents to Dalla Betta et al. teach catalytic and non-catalytic channels of different shape and tortuosity, the average channel properties (over some finite length) are not varied in the longitudinal direction, so that the catalytic reactors taught are effectively one- or two-dimensional in terms of channel flow properties such as bulk heat transfer coefficient, velocity, or average cross-sectional shape or area.

In general, the prior art backside-cooled catalytic reactors include a multitude of catalytic channels, where each individual catalytic channel is in essence a separate catalytic reactor. As a result, variations in fuel/air ratio from channel to channel (due to imperfect premixing, for example) can lead to different degrees of combustion and heat release in different channels. Likewise, variations in inlet temperature from channel to channel can also lead to variations in combustion behavior in different channels. Rate of reaction, catalyst light-off length, and maximum gas or surface temperature can all be affected by the temperature and fuel/air ratio at a channel inlet. In addition, manufacturing tolerances may result in unequal physical properties of different channels. Properties which may vary include channel size, wall thickness, catalyst or washcoat thickness, and catalyst loading; each of these may affect combustion behavior. In essence, multiple catalytic channels can produce widely varying degrees of catalytic combustion.

Because there is no mixing between separate catalytic channels in the prior-art backside-cooled reactors, the reactors suffer the above-mentioned disadvantages of sensitivity to premixing (fuel/air ratio) and sensitivity to inlet temperature uniformity. Given that all real systems have some level of gas-stream non-uniformity, these sensitivities translate to a narrowed operating range.

It has now been found that structures and methods that provide an un-partitioned exothermic catalytic reaction channel and multiple cooling channels offer superior performance. The un-partitioned exothermic catalytic reaction channel allows for continual mixing of the fuel/oxidant stream within the channel leading to a more uniform combustion and a wider operating range.

In addition, the structure of the present invention is more flexible, facilitating cross-stream area changes in the streamwise or longitudinal direction, since there is no constraint that walls contact each other to form multiple catalytic channels. Thus, the invention can be used to vary the bulk fluid properties in the streamwise or longitudinal direction via cross-stream area changes. In particular, it may be desirable to reduce the velocity of the fuel/air mixture after it has entered the exothermic catalytic reaction channel, to provide greater residence time for reaction within the reactor, while maintaining sufficient velocity at the reactor inlet to prevent flashback to the fuel/oxidant mixture upstream of the reactor.

SUMMARY OF THE INVENTION

The present invention, a catalytic firebox reactor, is a catalytic reactor employing an un-partitioned exothermic catalytic reaction channel and multiple cooling conduits passing through the exothermic catalytic reaction channel. An oxidation catalyst is deposited on the exterior surfaces of the conduits within the exothermic catalytic reaction channel. This placement of the catalyst allows the oxidation catalyst to be backside cooled by any fluid passing through the cooling conduits. Backside cooling means that at each location where an oxidation catalyst is deposited on one surface of a wall no oxidation catalyst is deposited on an adjacent or opposite surface in contact with the cooling fluid, and a portion of the heat generated by reaction on the oxidation catalyst is conducted through the substrate to the adjacent or opposite surface that is in direct contact with the cooling fluid.

The catalytic firebox reactor can be made in numerous configurations with the following common elements. A casing forms the outer boundary, which can be of any shape. The reactor casing can be a single fabricated component, or can consist of two or more components (such as a mixing duct and a conduit support duct) joined together. Two or more conduits are placed within the casing such that one fluid stream can traverse an un-partitioned channel, the exothermic catalytic reaction channel, defined by the interior surface of the casing and the exterior surfaces of the conduits, and a number of separate fluid streams can traverse the passages defined by the interior surfaces of the conduits, without mixing occurring between fluid in the exothermic catalytic reaction channel and fluid in the conduits' interior passages. A heat transfer relationship exists between the fluid in the exothermic catalytic reaction channel and the fluids in the conduits' interior passages.

The exothermic catalytic reaction channel is the region between the conduits' exterior surfaces and the reactor casing's interior surface, beginning immediately downstream of the most downstream conduit inlet and ending immediately upstream of the most upstream conduit outlet (note that the most downstream conduit inlet is upstream of the most upstream conduit outlet). This region forms an un-partitioned channel because an intentional gap is made between adjacent conduits for some portion of the conduits' length, within the exothermic catalytic reaction channel. The term "un-partitioned" means that any two points within the channel can be connected by a path contained entirely within the channel. The terms "upstream" and "downstream" refer to the location of imaginary cross-stream surfaces, so that points which are not on the same streamline can have a definite upstream-downstream relationship. "Cross-stream" means perpendicular to the flow, so that streamlines of the flow always intersect a cross-stream surface perpendicularly. Thus, a first point is said to be upstream of a second point if the cross-stream surface on which the first point lies is upstream of the cross-stream surface on which the second point lies.

The intentional gaps between adjacent conduits allow the exothermically catalyzed fluid to mix as the fluid catalytically reacts, so that non-uniformities in fluid velocity, fluid composition, and fluid temperature are ameliorated before the fluid exits the reactor. Incidental leakage of the exothermically catalyzed fluid between adjacent conduits is not considered an intentional gap. Rather, the intentional gaps must be of sufficient size that fluid may freely pass through the gaps. Specifically, this means that the sum of the flow areas through all of the gaps within the exothermic catalytic reaction channel must be greater than the channel's minimum cross-stream flow area. The cross-stream flow area of the exothermic catalytic channel, at any given streamwise location, is the area over which exothermically catalyzed fluid passes through an imaginary cross-stream surface within the channel. For flow through a gap between adjacent conduits, the flow area is defined as the minimum area within the exothermic catalytic reaction channel of an imaginary surface which passes through the axial (streamwise) centerlines of both conduits and which extends between a straight line connecting the two conduit inlets and a straight line connecting the two conduit outlets. While it is possible to have intermediate support structures within the exothermic catalytic reaction channel which locally close off one or more gaps between adjacent conduits, these support structures are open to the passage of fluid from the upstream portion of the reactor to the downstream portion of the reactor, and do not significantly reduce the continual mixing of fluid within the exothermic catalytic reaction channel.

Oxidation catalyst is deposited on at least a portion of the conduits' exterior surfaces within the exothermic catalytic reaction channel. The oxidation catalyst provides the exothermic reaction surface which supports the exothermic oxidation of fuel within the exothermic catalytic reaction channel. Catalyst coating may be applied to all of the conduits, or to only some of the conduits (leaving some of the conduits un-coated). In general, it is preferred that no oxidation catalyst is applied upstream of the most downstream conduit inlet, so that catalyzed fluid cannot enter any of the cooling conduits.

The conduits can be made in numerous configurations (cylindrical, fluted, externally finned, internally finned, internally partitioned, of round, lobed, polygonal, elliptical, or other cross-sectional shapes, straight or twisted, and so on), and can be arranged in numerous configurations within the casing (square-packed, close-packed, braided or spiraled, crisscrossed, and so on) using conduits of equal or unequal cross-sectional size, and of equal or unequal length. In all configurations, an intentional gap exists between adjacent conduits for some portion of the conduits' length, so that fluid in the exothermic catalytic reaction channel pass between adjacent conduits, thereby allowing an un-partitioned exothermic catalytic reaction channel to exist within the reactor casing. A conduit may contain a single cooling passage, as in a simple tube for example, or a conduit may contain more than one cooling passage. For example, two parallel straight tubes may be joined to form a single conduit containing two cooling passages. Alternatively, a divider may; be inserted in a single tube to create a conduit containing two cooling passages. Three or more cooling passages may also be formed in a single conduit, if desired. In all configurations, however, oxidation catalyst is applied only to the conduits exterior surfaces, and the conduits must be configured with an intentional gap between adjacent conduits such that a single exothermic catalytic reaction channel is formed.

The present invention is also a method for using a backside-cooled catalyst structure, wherein the velocities of the exothermically catalyzed stream and the cooling stream may be separately varied as the streams pass through the reactor, and in particular where the velocity of the exothermically catalyzed stream is reduced, after the stream enters the exothermic catalytic reaction channel, by a streamwise increase in the cross-sectional (cross-stream) area of the exothermic catalytic reaction channel. The term "streamwise" means in the direction of the flow. The catalytic firebox structure can be configured to accomplish this variation of velocity by a streamwise reduction in the cross-stream area of the cooling conduits, resulting in a streamwise increase in the cross-stream area of the exothermic catalytic reaction channel, if the wall thickness between the cooling conduits and the exothermic catalytic reaction channel remains unchanged, and if the total cross-stream area of the reactor (including both the cooling conduits and the exothermic catalytic reaction channel) remains unchanged. Other means for reducing the velocity of the exothermically catalyzed stream area also possible, such as limiting the entrance flow area to the exothermic catalytic reaction channel by a baffle, plate, or other structure.

In the present invention, the cooling fluid and the exothermically catalyzed fluid comprise portions of an ultimate combustion mixture. As a fuel/oxidant mixture passes through the exothermic catalytic reaction channel it catalytically reacts. The heat of reaction is added to both the fluid in the exothermic catalytic reaction channel and the fluid passing through the cooling conduits. After discharge of the fluids from the exothermic catalytic reaction channel and from the cooling conduits, the fluids are allowed to mix such that a single combined flow is created.

DETAILED DESCRIPTION OF THE PREFERRED EMBODIMENTS

Figure 1:
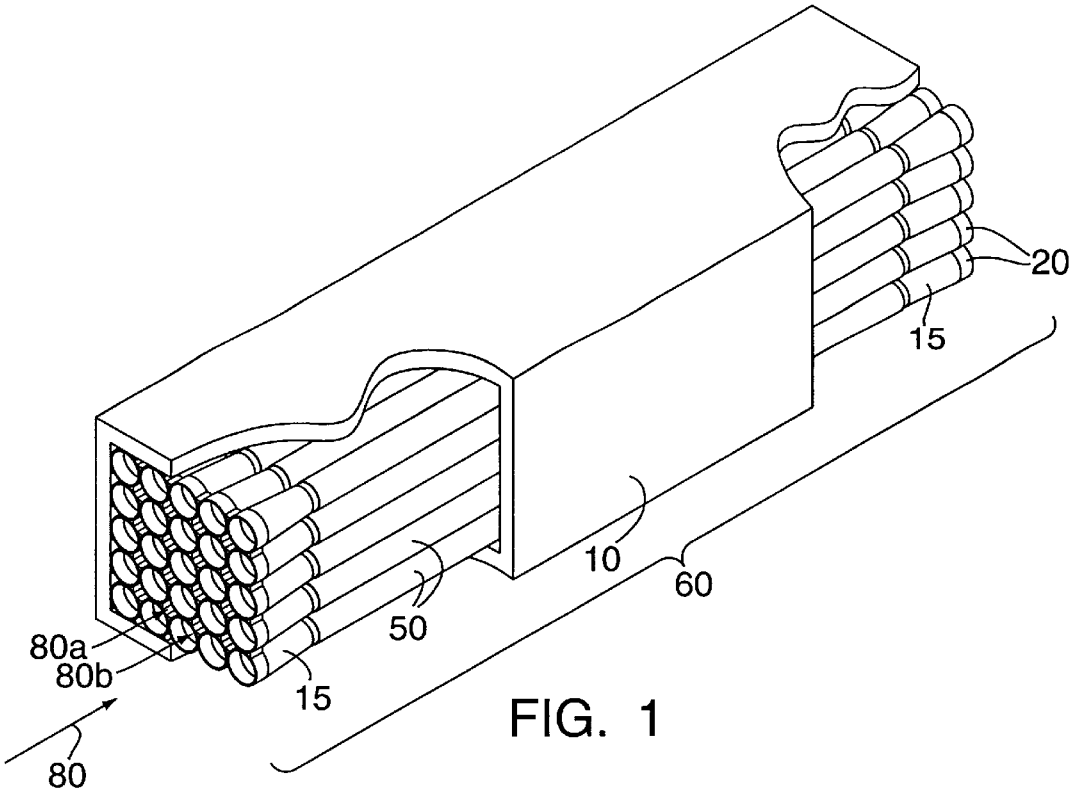
FIG. 1 illustrates the basic catalytic firebox reactor.

As shown in FIG. 1, the catalytic firebox reactor is a structure comprised of an exothermic catalytic reaction channel 60 penetrated by multiple cooling conduits 20 for backside cooling of oxidation catalyst 50 supporting the reaction within the channel. In the operation of this reactor a portion of a fuel/oxidant mixture 80, 80*a*, enters the exothermic catalytic reaction channel 60 and is exothermically catalytically reacted on oxidation catalyst 50, while simultaneously a portion the fuel/oxidant mixture 80, 80*b*, enters the multiple cooling conduits 20 and cools the catalyst 50. The exothermically catalyzed fluid 80*a* then exits the exothermic catalytic reaction channel 60 and mixes with the cooling fluid 80*b* exiting the multiple cooling conduits, creating a heated combustible fuel/oxidant/product mixture.

FIG. 1 depicts a catalytic firebox reactor employing an exothermic catalytic reaction channel with an interstitial entrance and exit strategy. The reactor is comprised of a casing 10 into which conduits 20 are placed. An oxidation catalyst 50 is deposited on the exterior surfaces of the conduits 20 within the exothermic catalytic reaction channel 60. The conduits are expanded at their inlets and outlets. In the depiction shown in FIG. 2 the reactor is fabricated from a square-packed arrangement of parallel, equal-length, cylindrically-shaped conduits 20. In the configuration shown, the expanded sections 15 perform the dual function of creating a single un-partitioned exothermic catalytic reaction channel by providing a gap between the conduits, and creating an entrance into (and exit from) the exothermic catalytic reaction channel by creating a series of interstices between adjacent expanded end-sections. A similar configuration could be created by expanding the conduits near, but not at, their inlets and outlets (an example of this is shown later, in FIG. 8). In the operation of this configuration a single fuel/air mixture stream enters the casing and is split between the exothermic catalytic reaction channel and the multiple conduits' cooling passages. At the exit of the reactor the catalyzed stream and the cooling streams mix to create a single heated, partially reacted, fuel/air/product mixture stream.

In the configuration shown in FIG. 1, the expanded sections 15 at the ends of each conduit are cylindrical (round), and are concentric with the conduit centerlines. Other cross-sectional shapes of the expanded sections are also possible, including ellipses, squares, hexagons, octagons, lobed shapes ("clover-leaf"), and so on. In general, the term "expanded" means that at some axial location the maximum diameter of the conduit is greater than the maximum diameter of the conduit at other axial locations.

Figure 2:
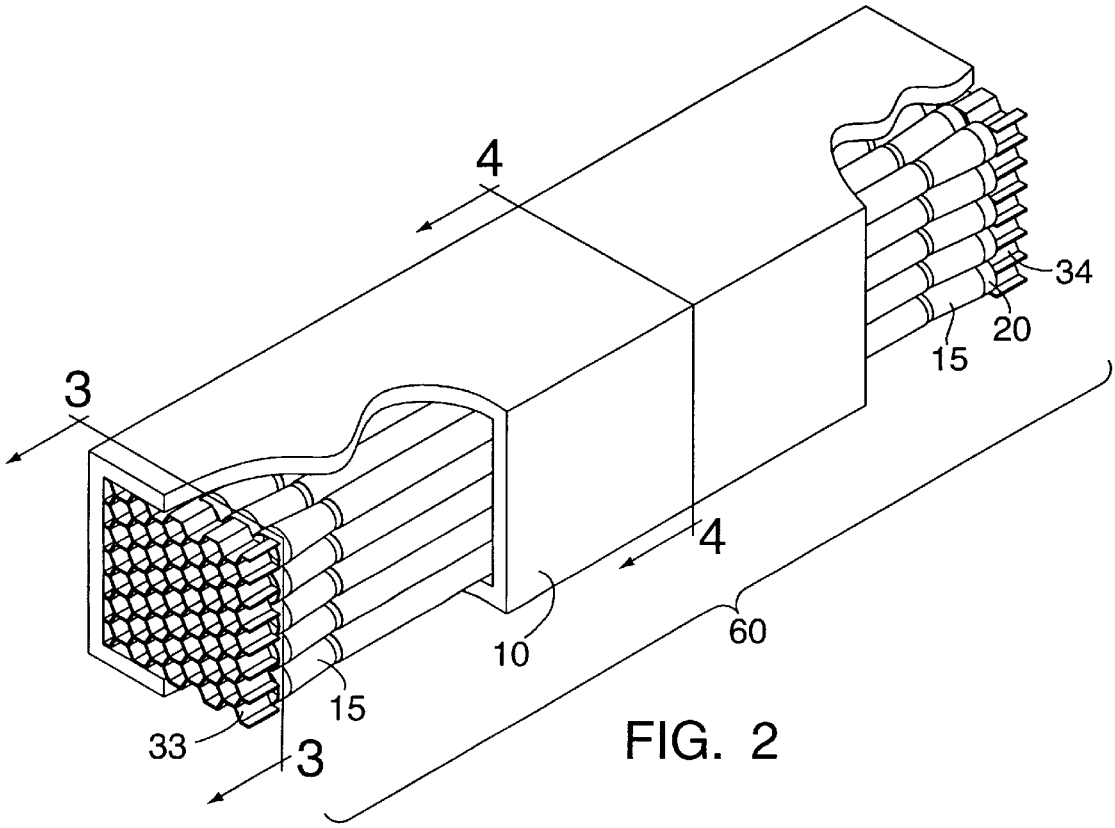
FIG. 2 illustrates a second embodiment of a catalytic firebox reactor employing expanded conduit end-sections in conjunction with retainers.
Figure 3:
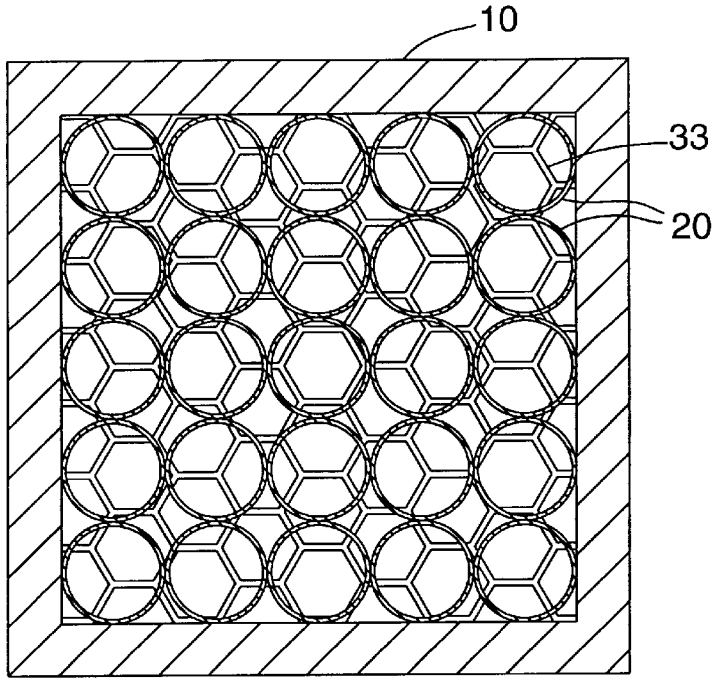
FIG. 3 is a cross-sectional view of the catalytic firebox reactor of FIG. 2 taken immediately downstream of the conduit entrance looking upstream.
Figure 4:
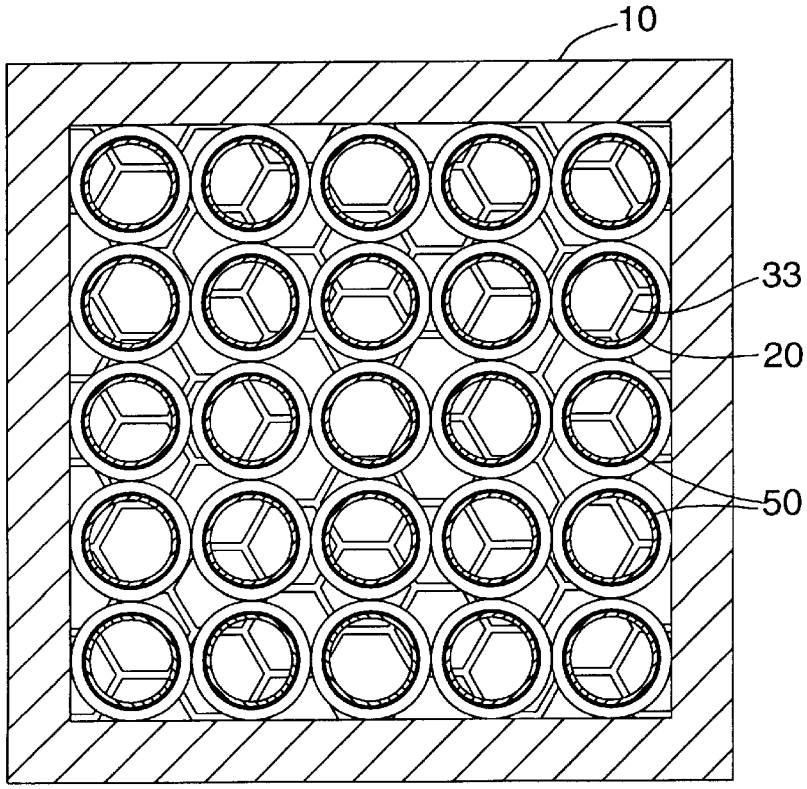
FIG. 4 is a cross-sectional view of the catalytic firebox of FIG. 2 taken in approximately the center of the reactor looking upstream.

FIG. 2 shows another embodiment of a catalytic firebox reactor employing expanded conduit end-sections 15 in conjunction with a retainer strategy. In this embodiment the conduits 20 are expanded at the inlets and outlets and positioned within casing 10. The expanded sections position the conduits 20 laterally within the casing 10. A first retainer 33 is positioned at or near the conduit inlets and a second retainer 34 is positioned at or near the conduit outlets. The retainers, 33 and 34, longitudinally position conduits 20 within the casing. FIG. 3 is a cross-section of this reactor taken immediately downstream of the conduit entrances, looking upstream, showing that the expanded end-sections position the conduits 20 laterally within the casing 10 and provide interstices for fluid to enter the exothermic catalytic reaction channel. FIG. 4 is a cross-section of this reactor taken in the middle looking upstream and shows that the expanded sections create a single un-partitioned exothermic catalytic reaction channel by providing gaps between the conduits 20. The retainers 33 and 34 are shown as honeycombs. For this case, the cell size of the honeycomb is no larger than the expanded conduit ends, so that the conduits are not able to pass through the honeycomb cells. As in the configuration of FIG. 1, oxidation catalyst 50 is deposited on the exterior surfaces of the conduits 20 within the exothermic catalytic reaction channel 60.

Figure 5:
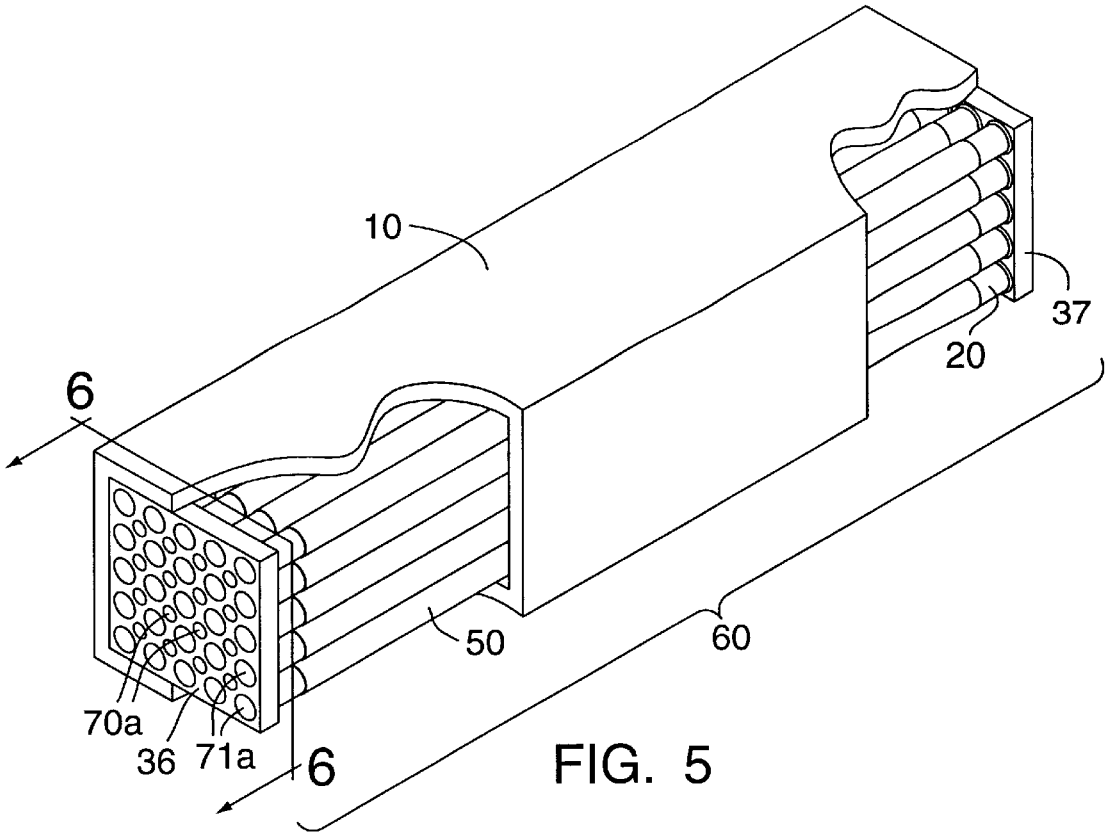
FIG. 5 illustrates a catalytic firebox reactor employing a retainer strategy that does not require expanded conduit end sections.
Figure 6:
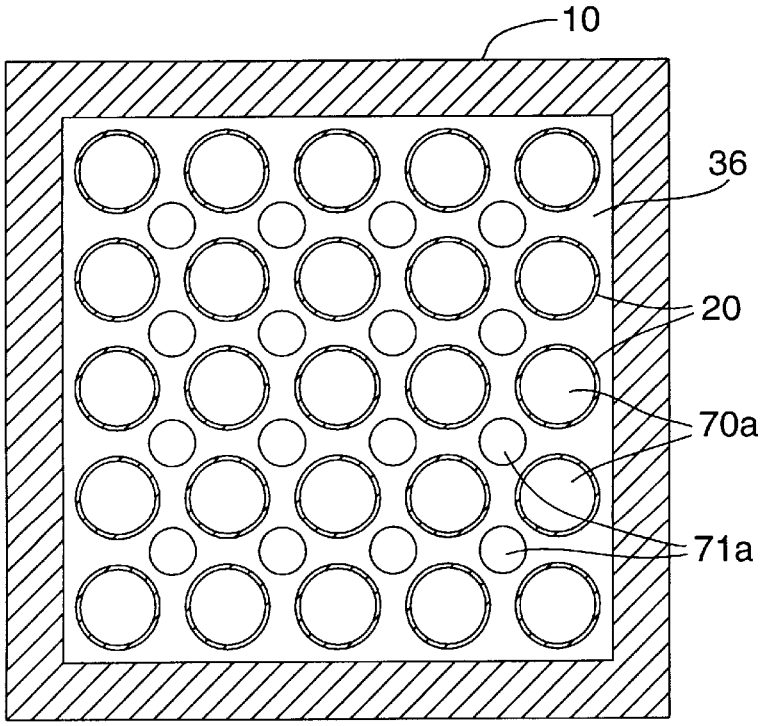
FIG. 6 is a cross-section of the catalytic firebox reactor shown in FIG. 5 taken just downstream of the conduit entrances looking upstream.

FIG. 5 shows another configuration of the reactor employing a retainer strategy. In this reactor the conduits 20 are inserted in a first retainer 36 and a second retainer 37, and may or may not have expanded end-sections. The conduits may be attached to the first retainer 36, the second retainer 37, or both, by, for example, welding or brazing or press fit. If attachment at only one end is preferred, the conduits may slide freely through one of the retainers; for example, the conduits may be welded to the first retainer 36, but may slide freely through the second retainer 37. Like the honeycombs shown in FIG. 2, the retainers in FIG. 5 have passages that are open to the passage of fluid, as shown in FIG. 6. Passages 70*a* permit fluid to enter the exothermic catalytic reaction channel 60 while passages 70*b* (not shown) permit the fluid to exit. Passages 71*a* permit fluid to enter the conduits' 20 while passages 71*b* (not shown) permit the fluid to exit. Oxidation catalyst 50 is deposited on the exterior surfaces of conduits 20 within the exothermic catalytic reaction channel 60. A variation of the embodiment shown in FIG. 5 may incorporate only one retainer. In this case, the conduits pass through a single retainer 36, and may be attached to the retainer by, for example, welding or brazing or press fit.

Figure 7:
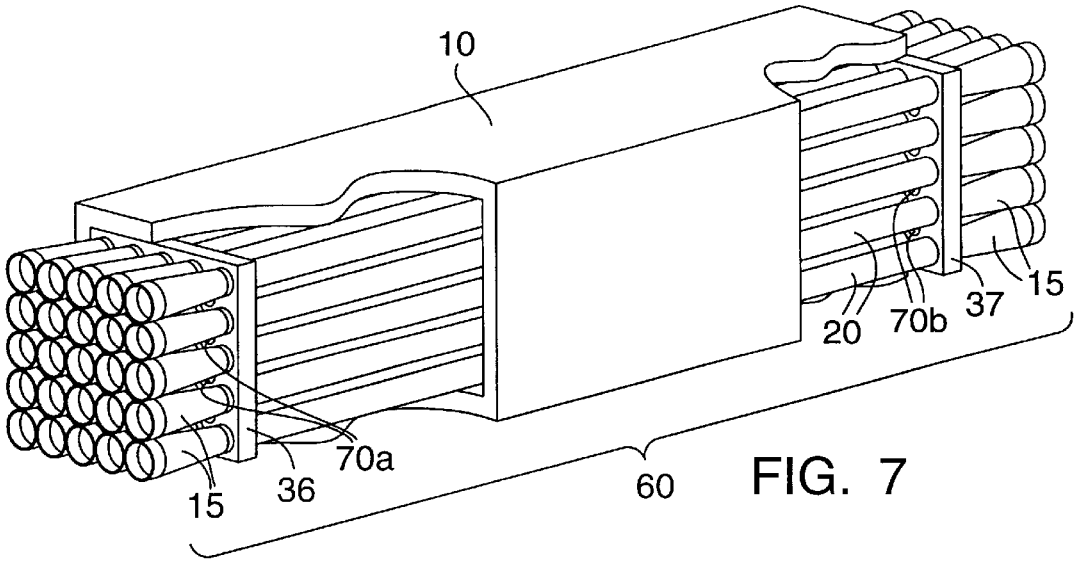
FIG. 7 illustrates a catalytic firebox reactor using localized expansion of the conduits to retain the conduits within the reactor.

FIG. 7 shows a similar configuration to that shown in FIG. 5, but shows a different method of retaining the conduits. In FIG. 7, the conduits 20 are inserted through a first retainer 36 and a second retainer 37, but are not attached to the retainers. Instead, each conduit passes through the retainers and is expanded at each end, to a size which does not permit the expanded conduit ends 15 to pass through the retainers. Thus, no attachment to the retainers is required, and the conduits may slide freely through the retainers until an expanded end contacts a retainer. The retainers are attached to the reactor casing 10. As in FIG. 5, the retainers in FIG. 7 have passage 70*a* and 70*b* that permit fluid to enter and exit the exothermic catalytic reaction channel 60, respectively. Oxidation catalyst 50 is deposited on the exterior surfaces of conduits 20 within the exothermic catalytic reaction channel 60.

Figure 8:
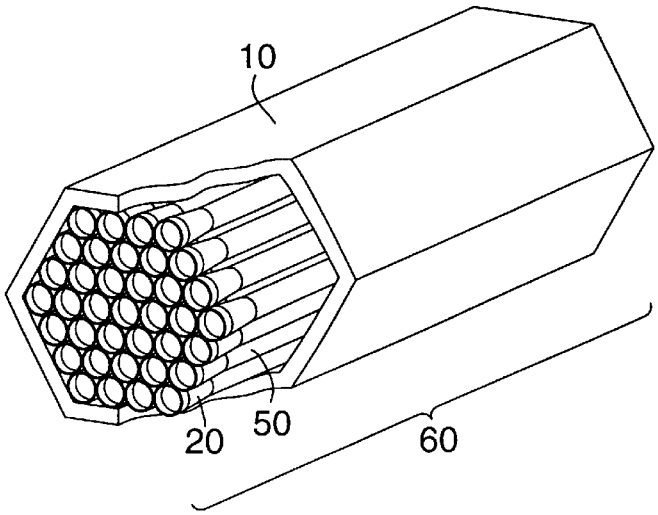
FIG. 8 illustrates a catalytic firebox reactor of close-packed configuration with expanded-end conduits.

A close-packed configuration of expanded-end conduits is shown in FIG. 8. In this close-packed arrangement, the conduits 20 are arranged within casing 10 with the conduit centerlines lying on an imaginary grid consisting of adjacent equal-size equilateral triangles, so that each conduit is in direct contact with those adjacent at the expanded end-sections. The imaginary grid lines in this close-packed case consist of three sets of parallel, equally-spaced lines, each set of lines being oriented at a 60-degree angle from each other set of lines. In the example shown in FIG. 8 the conduits are attached to one another forming a bundle and conduits adjacent to the casing are attached to the casing by, for example, welding or brazing. Oxidation catalyst 50 is deposited on the exterior surfaces of conduits 20 within the exothermic catalytic reaction channel 60.

Figure 9:
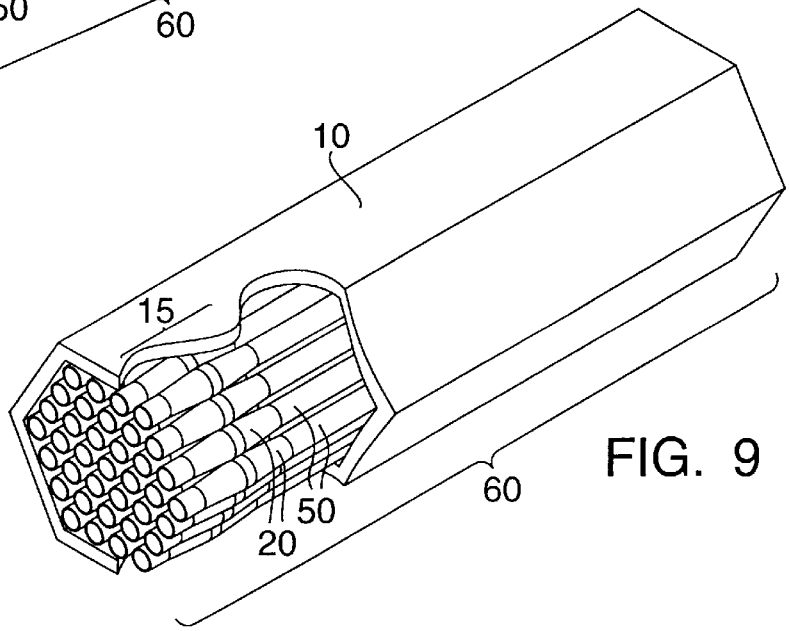
FIG. 9 illustrates a close-packed configuration of a catalytic firebox reactor with intermediate conduit expansion.

FIG. 9 illustrates another close-packed configuration of conduits 20. In this example, the expanded conduit sections 15 are located near, but not at, the tube ends. Thus, the conduits are supported and located laterally in the same manner as in FIG. 8, but the inlet face to the reactor differs between the two cases. In particular, since the conduits 20 are expanded at their inlets in FIG. 8 but are not expanded at their inlets in FIG. 9, the ratio of the inlet area of the conduits 20 to the total reactor cross-stream area (defined by the casing 10 size) is greater in FIG. 8 than in FIG. 9. In the example shown in FIG. 9, the conduits are attached to one another at their expanded sections, and conduits adjacent to the casing are attached to the casing at their expanded sections, by for example welding or brazing. Oxidation catalyst 50 is deposited on the exterior surfaces of conduits 20 within the exothermic catalytic reaction channel 60.

Comparing the reactor configurations shown in FIGS. 1, 8, and 9, it is clear that in all cases shown a single fuel/air mixture stream enters the casing and is split between the exothermic catalytic reaction channel and the multiple conduits' cooling passages (note, however, that this is not required; separate fuel/air mixture streams may enter separate portions of the reactor, if proper manifolding is provided). The percentage of the initial fuel/air mixture stream which enters the exothermic catalytic reaction channel is approximately determined by the effective flow area of the cooling passages within the cooling conduits versus the effective flow area of the exothermic catalytic reaction channel, since the total pressure drop from reactor inlet to reactor exit is the same across each flow path. While there are many variables which determine the effective area of each flow path, the effective areas are in part determined by the cross-stream area at the entrance to a passage or channel. Thus, for similar size, shape, and length conduits, a greater percentage of the flow will enter the exothermic catalytic reaction channel in the configuration of FIG. 1 (square-packed) than in the configuration of FIG. 8 (close-packed), and a greater percentage of flow will enter the exothermic catalytic reaction channel in the configuration of FIG. 9 (expanded near, but not at, the conduit ends) than in the configuration of FIG. 8 (expanded at the conduit ends).

As stated above the invention requires that the fluid exiting the exothermic catalytic reaction channel exit and the fluid exiting the conduit outlets must come into contact to permit some degree of mixing to form the ultimate combustion mixture. To accomplish this, the exothermic catalytic reaction channel exit and the conduit outlets must be proximately located. Proximately located means that the exits are spatially located to permit the fluids exiting the exit and the outlets to come in contact so some degree of mixing is possible prior to ultimate combustion. FIGS. 1, 2, 5, 8 and 9 show the closest possible streamwise proximate locations of the exothermic catalytic reaction channel exit and the conduit outlets, occurring essentially at the same streamwise location. FIG. 7 shows a configuration where the conduit outlets are downstream of the exothermic catalytic reaction channel.

FIGS. 1 through 9 illustrate several strategies for retaining the conduits 20 within casing 10. The invention does not require symmetry in securing the upstream and downstream ends of the conduits and the different securing structures illustrated could be combined in a single embodiment. For example, the conduits 20 could be secured at the upstream end by a retaining structure and at the downstream end by an expanded conduit structure. In addition, it must be realized that the casing and the conduits may operate at different temperatures, resulting in different amounts of thermal expansion. Thus, in the configuration shown in FIG. 2 for example, clearance may be provided between the conduits and the upstream or downstream retainers, to allow for thermal growth of the conduits. In the configuration shown in FIG. 1, the conduits may be secured (by welding, for example) to each other and to the casing only at one end, as for example at the inlet or upstream end, with the other end free to move longitudinally so that differential thermal growth of the conduits may be accommodated. If a clearance is allowed between the conduits and the retainer(s), or if differential thermal growth between adjacent conduits is expected, the conduits' expanded sections (if employed) should be of sufficient axial length that lateral support and positioning of the conduits is provided even when adjacent tubes move in opposite axial directions to the maximum extent allowed by the clearance space or the expected difference in thermal growth. If the conduits penetrate or pass through the retainers, as in FIGS. 5 and 7, respectively, and if they are laterally positioned by the retainers, the expanded sections need not provide lateral support to the conduits. In this case, it may also be advantageous to allow the conduits to slide freely through at least one of the retainers, to allow for thermal expansion of the conduits.

Conduits 20 can be fabricated from metal, preferably a high-temperature-tolerant alloy suitable for the application, which provides good heat transfer from the oxidation catalyst 50 to the cooling fluid contacting the interior surface of conduits 20. Conduits 20 may have any wall thickness. Generally, thinner walls will be weaker and less resistant to long-term oxidation, while thicker walls will result in increased pressure drop through the reactor. The preferred wall thickness is between 0.05 mm and 2 mm, with wall thicknesses between 0.1 mm and 1 mm being most preferred. If expanded sections are employed minor variations in wall thickness are acceptable. Casing 10 is also fabricated from high-temperature tolerant materials. Wall thickness is based upon the application.

Oxidation catalyst 50 is applied to the exterior of conduits 20 within the exothermic catalytic reaction channel. While the entire exterior of conduits 20 could be catalyst coated, as a practical matter catalyst coatings should not be applied where the channels touch one another or the casing 10. This allows close fabrication and assembly tolerances, without concern for variable coating thickness, and allows for welding or brazing of metal-to-metal contact points, if desired.

The reactor can also incorporate streamwise variation of the fluid velocities. Specifically, the velocity of the fluid in the exothermic catalytic reaction channel can be decreased after the fluid enters the channel by streamwise geometric changes in the reactor wherein the channel's entrance flow area is less than the channel's cross-stream flow area at some streamwise location where catalyst 50 is deposited. The channel's entrance flow area is defined as the channel's cross-stream flow area immediately downstream of the most downstream conduit inlet. If the conduit wall thicknesses are approximately constant, streamwise changes in flow velocity can be produced by providing, for example, either contracted sections of the conduits 20, expanded sections of the casing 10, or a combination of both. In a reactor employing expanded-end conduits 20 (or, equivalently, contracted center sections), as in FIGS. 1, 2, or 8, the cross-stream area of conduits 20 decreases just after the cooling flow enters the cooling passages, where the expanded conduit sections taper down to the nominal conduit size in the central portion of the reactor. As a result, the cooling flow velocity is increased to a value greater than its entrance velocity. Conversely, because the casing 10 is of constant cross-sectional size, the cross-stream flow area of the exothermic catalytic reaction channel increases just after the fuel/oxidant mixture enters. As a result, the flow velocity in the exothermic catalytic reaction channel is decreased to a value less than its entrance velocity.

The gas flow velocity entering the exothermic catalytic reaction channel should exceed the minimum required to prevent flashback into the fuel/oxidant stream upstream of the reactor if the fuel/oxidant mixture entering the exothermic catalytic reaction channel is within the limits of flammability. The laminar flame propagation velocity (velocity of a laminar deflagration wave) is typically less than 1 m/s for hydrocarbon fuels in air, but the turbulent flame propagation velocity may exceed 10 m/s and may approach 30 m/s for highly turbulent flow. To prevent flashback, the gas flow velocity should exceed 10 to 30 m/s at gas turbine engine conditions, or more if a safety margin is allowed. Because catalyst light-off becomes increasingly difficult with increasing velocity, it is desirable to reduce the velocity of the fuel/air stream once it has entered the exothermic catalytic reaction channel, by for example a streamwise variation of cross-stream area as discussed above. In the preferred embodiment of the present invention, the flow velocity of the fuel/air stream over the exothermic reaction surface (oxidation catalyst) in the exothermic catalytic reaction channel is nominally 30 m/s or less. This reduction in velocity is achieved by a streamwise increase in the cross-stream area for flow over the exothermic reaction surface. Streamwise changes in cross-stream area are fixed by the geometry of the reactor, and do not change in time.

The velocity of the cooling stream should exceed the maximum flame propagation velocity (nominally 10 to 30 m/s or more) at the exit of the cooling conduits, if the cooling fluid exiting the cooling passages is within the limits of flammability, to prevent flashback from a downstream combustion chamber. If expanded conduit outlets are employed, it is also very important that the downstream increase in cross-stream area of the cooling conduits 20 is sufficiently gradual that recirculation of the cooling flow does not occur, so that there is no possibility of flashback or flameholding in the downstream expanded conduit section. Typically the cone angle for an axi-symmetric diffuser section should not exceed approximately 8 to 10 degrees for good pressure recovery and minimal recirculation. If continued backside cooling is a consideration, the angle should be especially shallow (less than 4 or 5 degrees for an axi-symmetric section) to ensure that there is no local separation of the cooling flow and concurrent loss of cooling effectiveness.

Also, when the fuel/air ratio in the cooling channels is within the limits of flammability, it is preferred that the cross-stream area for flow through the cooling channels is not increased after the cooling stream enters conduits 20. The cross-stream area of the cooling passages may in fact be decreased to increase the cooling flow velocity for greater resistance to flashback or pre-ignition in the cooling portion of the reactor. The minimum residence time for pre-ignition to occur in conduits 20 is dependent upon fuel type, fuel/air ratio, temperature, and pressure, and can be measured experimentally or calculated on the basis of elementary chemical reaction rates, if known. Gas temperatures in the cooling portion of the reactor may rise to near the material limit of the catalyst and substrate (near 1200 Kelvin for precious metal catalysts), resulting in very short ignition delay times, possibly as short as 2 ms for natural gas in air at pressures near 10 atm. To prevent pre-ignition in the cooling portion of the reactor, the gas residence time in the cooling portion of the reactor should be less than the ignition delay time. Increasing the cooling flow velocity within the cooling passages reduces the residence time of the cooling fluid within the reactor, and reduces the cooling fluid's propensity for pre-ignition. Similarly, decreasing the velocity of the fluid in the exothermic catalytic reaction channel provides increased residence time for reaction in a given length reactor, while the cooling fluid's residence time within the same length reactor remains at a smaller value, allowing a reduced propensity for pre-ignition of the cooling fluid.

Regardless of the specific catalytic firebox reactor configuration, the reactor should be capable of providing good contact between the oxidation catalyst and the fuel/oxidant mixture in the exothermic catalytic reaction channel. For catalytic combustion applications, it is preferred that the reactor be sized such that the reaction of the fuel/oxidant mixture in the exothermic catalytic reaction channel should proceed more than 50% of the way to completion before exiting. For fuel-lean mixtures, this means that more than 50% of the fuel entering the channel should be consumed. Most preferably, more than 75% of the fuel entering the exothermic catalytic reaction channel should burn before exiting.

The percentage of reaction completed in the exothermic catalytic reaction channel depends both upon the flow rate of the fuel/oxidant mixture through the exothermic catalytic reaction channel and upon the physical characteristics of the catalytic firebox reactor. The chemical composition of the fuel/oxidant mixture may also affect the percentage of reaction completed, particularly if the rate of chemical reaction is significantly limiting when compared to the rate of mass transfer to the catalyst surface.

With regard to percentage of reaction completed, important physical characteristics within the exothermic catalytic reaction channel include the rate of mass transfer to the oxidation catalyst surface, the ratio of oxidation catalyst surface area to reaction channel volume, and the activity of the oxidation catalyst.

In a square-packed conduit configuration (parallel conduits bundled such that the conduit centerlines are arranged on an imaginary square grid), as shown in FIG. 5, the conduits are preferably between 2 mm and 8 mm in diameter, and between 75 mm and 400 mm in length, for a catalytic combustion application in which the average velocity of the fuel/air mixture entering the reactor is between 20 m/s and 100 m/s. A close-packed reactor would have conduits with dimensions in approximately the same ranges as those for the square-packed reactor.

The fuel may comprise C1 to C20 hydrocarbons, C1 to C20 hydrocarbon oxygenates, and blends thereof. Suitable gaseous fuels include natural gas, methane, and propane. Suitable liquid fuels include gasoline, kerosene, No. 1 heating oil, No. 2 heating oil, and conventional aviation turbine fuels such as Jet A, Jet B, JP-4, JP-5, JP-7, and JP-8. "Hydrocarbon" not only refers to organic compounds, including conventional liquid and gaseous fuels, but also to gas streams containing fuel values in the form of compounds such as carbon monoxide, organic compounds, or partial oxidation products of carbon containing compounds. If the fuel is a liquid, it should be vaporized or atomized before mixing with oxidant or while being mixed with oxidant.

The exothermic catalytic portion of the catalytic firebox reactor may have as an active ingredient precious metals, group VIII noble metals, base metals, metal oxides, or any combination thereof. Elements such as zirconium, vanadium, chromium, manganese, copper, platinum, palladium, osmium, iridium, rhodium, ruthenium, cerium, cobalt, nickel, iron, and the like may be used. Platinum and palladium are preferred, palladium being especially preferred for use with natural gas or methane fuels. The oxidation catalyst may be applied directly to the substrate of the reactor, or may be applied to an intermediate bond coat or washcoat composed of alumina, silica, zirconia, titania, magnesia, other refractory metal oxides, or any combination thereof. The washcoat may be stabilized by the addition of additives such as lanthanum, cerium, barium, chromium, or other materials. Alumina washcoats are preferred for use with natural gas or methane fuels.

The catalyst-coated substrate may be fabricated from any of various high temperature materials. High temperature metal alloys are preferred, particularly alloys composed of iron, nickel, and/or cobalt, in combination with aluminum, chromium, and/or other alloying materials. High temperature nickel alloys are especially preferred. Other materials which may be used include ceramics, metal oxides, intermetallic materials, carbides, and nitrides. Metallic substrates are most preferred due to their excellent thermal conductivity, allowing effective backside cooling of the catalyst.

What is claimed is:

1. A catalytic firebox reactor comprising:

a casing having an inlet and an outlet, and an interior surface and an exterior surface, the casing interior surface defining an interior chamber;

at least two conduits, each conduit having an inlet and an outlet, and an interior surface and an exterior surface, the conduits retained within the interior chamber, the conduit exterior surfaces and the casing interior surface forming an exothermic catalytic reaction channel having an exit, the exothermic catalytic reaction channel exit and the conduit outlets proximately located such that a first fluid upon exiting the conduit outlet is in contact with a second fluid that has exited the exothermic catalytic reaction channel, and an oxidation catalyst deposited within the exothermic catalytic reaction channel on at least a portion of at least one of the conduit exterior surfaces, the oxidation catalyst being backside cooled from the conduit interior surface by the second fluid.

2. A catalytic firebox reactor of claim 1 wherein the conduits are retained by a retainer, the conduits passing through the retainer and connected thereto and the retainer connected to said casing, the retainer having passages therethrough.

3. A catalytic firebox of claim 1 wherein the conduits are retained by connecting the conduits to each other forming a bundle, the bundle connected to said casing, wherein at least one of any two adjacent conduits has at least one first expanded cross-section, the first expanded cross-section being sufficient to create the exothermic catalytic reaction channel.

4. A catalytic firebox of claim 3 wherein the conduit with the first expanded cross-section has a second expanded cross-section, the first expanded cross-section being located near the conduit inlet and the second expanded cross-section being located near the conduit outlet.

5. A catalytic firebox reactor of claim 1 wherein the conduits are retained by a single attachment, whereby the conduits are free to expand axially.

6. A catalytic firebox reactor of claim 5 wherein the single attachment is a retainer, the retainer being open to the passage of fluid, the retainer being attached to said casing.

7. A catalytic firebox reactor of claim 5 wherein said single attachment location is near the upstream end of said conduits.

8. A catalytic firebox reactor comprising:

a casing having an inlet and an outlet, and an interior surface and an exterior surface, the casing interior surface defining an interior chamber;

at least two conduits, each conduit having an inlet and an outlet, and an interior surface and an exterior surface, the conduits retained within the interior chamber, the conduit exterior surfaces and the casing interior surface forming an exothermic catalytic reaction channel having an exit, the exothermic catalytic reaction channel exit and the conduit outlets proximately located such that a first fluid upon exiting the conduit outlet is in contact with a second fluid that has exited the exothermic catalytic reaction channel, wherein the conduits are retained within the casing by a securing structure comprising a first retainer that is open to the passage of fluid connected to said casing upstream of the conduit inlets, and a second retainer that is open to the passage of fluid connected to said casing downstream of the conduit outlets wherein at least one of any two adjacent conduits has at least one locally expanded cross-section whereby when aggregated with the adjacent conduit creates the exothermic catalytic reaction channel; and an oxidation catalyst deposited within the exothermic catalytic reaction channel on at least a portion of at least one of the conduit exterior surfaces.

9. A catalytic firebox of claim 8 wherein there are at least two locally expanded cross-sections, a first cross-section located near the conduit inlet and a second cross-section located near the conduit outlet.

10. A catalytic firebox reactor comprising:

a casing having an inlet and an outlet, and an interior surface and an exterior surface, the casing interior surface defining an interior chamber;

at least two conduits, each having an inlet, an outlet, an interior surface and an exterior surface, the conduits retained within the interior chamber, the conduit exterior surfaces and the casing interior surface forming an exothermic catalytic reaction channel having an exit, the exothermic catalytic reaction channel exit and the conduit outlets proximately located such that a first fluid upon exiting the conduit outlet is in contact with a second fluid that has exited the exothermic catalytic reaction channel, wherein the conduits are retained by a single attachment, whereby the conduits are free to expand axially, wherein at least one of any two adjacent conduits has at least one locally expanded cross-section such that when aggregated with adjacent conduits the conduits are laterally positioned within the interior chamber, and the securing means is a bundle created by connecting adjacent conduits at a single attachment location and connecting the bundle to said casing; and an oxidation catalyst deposited within the exothermic catalytic reaction channel on at least a portion of at least one of the conduit exterior surfaces.

11. A catalytic firebox reactor comprising:

a casing having an inlet and an outlet and defining an interior chamber;

a first retainer positioned in the interior chamber connected to said casing, the first retainer being open to the passage of fluid;

a second retainer positioned within said interior chamber downstream of the first retainer connected to said casing, the second retainer being open to the passage of fluid;

at least two conduits, each conduit having an inlet and an outlet and an interior surface and an exterior surface, the conduits positioned longitudinally within the interior chamber, the conduits connected to the retainers, the conduit exterior surfaces and the casing interior surface forming an exothermic catalytic reaction channel having an exit, the exothermic catalytic reaction channel exit and the conduit outlets proximately located such that a first fluid upon exiting the conduit outlet is in contact with a second fluid that has exited the exothermic catalytic channel; and an oxidation catalyst deposited within the exothermic catalytic reaction channel on at least a portion of at least one of the conduit exterior surfaces, the oxidation catalyst being backside cooled from the conduit interior surface by the second fluid.

12. A catalytic firebox reactor comprising:

a casing having an inlet and an outlet and defining an interior chamber;

at least two conduits with a nominal cross-section, each conduit having an inlet and an outlet and an interior surface and an exterior surface, the conduits positioned within the interior chamber, each conduit inlet having a first expanded cross-section and a second expanded cross-section, the first and second cross-sections being sufficient to create an exothermic catalytic reaction channel having an exit, the exothermic catalytic reaction channel defined by the interior surface of said casing and the conduits exterior surfaces, the first expanded cross-sections connected to one another creating a bundle the bundle connected to said casing, and the exothermic catalytic reaction channel exit and the conduit outlets proximately located such that a first fluid upon exiting the conduit outlet is in contact with a second fluid that has exited the exothermic catalytic channel; and an oxidation catalyst deposited within the exothermic catalytic reaction channel on at least a portion of at least one of the conduit exterior surfaces, the oxidation catalyst being backside cooled from the conduit interior surface by the second fluid.

13. The catalytic firebox reactor of claim 12 wherein the first expanded cross-section is similar to and greater than the nominal conduit cross-section.

14. The catalytic firebox reactor of claim 13 wherein the second expanded cross-section is similar to and greater than the nominal conduit cross-section.

15. A catalytic firebox reactor comprising:

a casing having an inlet and an outlet and defining an interior chamber;

an inlet retainer having an upstream face and a downstream face, the inlet retainer connected to said casing within the casing inlet;

an outlet retainer having an upstream face and a downstream face, the outlet retainer connected to said casing within the casing outlet;

at least two conduits, each conduit having an inlet and an outlet and an interior surface and an exterior surface, the conduits positioned longitudinally within the interior chamber, the conduits extending through the inlet retainer and the outlet retainer, the conduits positioned by the inlet retainer and the outlet retainer, the conduit exterior surfaces and the casing interior surface forming an exothermic catalytic reaction channel having an exit, the exothermic catalytic reaction channel exit and the conduit outlets proximately located such that a first fluid upon exiting the conduit outlet is in contact with a second fluid that has exited the exothermic catalytic channel; and an oxidation catalyst deposited within the exothermic catalytic reaction channel on at least a portion of at least one of the conduit exterior surfaces.

16. A catalytic firebox reactor of claim 15 wherein the conduits are connected to the inlet retainer.

17. A catalytic firebox reactor of claim 15 wherein the conduits have a first expansion on the upstream side of the inlet retainer and a second expansion of the downstream side of the outlet retainer, said first and second expansion sufficient enough to prevent passage of the conduit through the retainer whereby the conduits are retained between the inlet retainer and the outlet retainer without fastening.

18. A catalytic firebox reactor comprising:

a casing having an inlet and an outlet and defining an interior chamber;

at least two conduits having an inlet and an outlet and an interior surface and an exterior surface, the conduits positioned longitudinally within the interior chamber;

a support plate being open to the passage of fluid positioned within said casing inlet connected to said casing, the conduits passing through the support plate and connected thereto within the interior chamber, the conduit exterior surfaces and the casing interior surface forming an exothermic catalytic reaction channel having an exit, the exothermic catalytic reaction channel exit and the conduit outlets proximately located such that a first fluid upon exiting the conduit outlet is in contact with a second fluid that has exited the exothermic catalytic channel; and an oxidation catalyst deposited within the exothermic catalytic reaction channel on at least a portion of at least one of the conduit exterior surfaces.

19. A method for creating a more reactive fuel/oxidant mixture, said method comprising:

generating a fuel/oxidant mixture;

passing a second portion of the fuel/oxidant mixture into cooling channels of a catalytic reactor;

simultaneously passing a first portion of the fuel/oxidant mixture into the catalytic reactor at an entrance velocity greater than the flame propagation velocity and into contact with exothermic reaction surfaces, the surfaces being in a backside cooled relationship with the cooling channels;

reducing the velocity of the first portion while in the catalytic reactor; and mixing the first portion and the second portion after exiting the catalytic reactor.

20. The method of claim 19 further comprising the step of increasing the velocity of the second portion while in the cooling channels.

21. A method for creating a more reactive fuel/oxidant mixture, said method comprising:

passing a first fuel/oxidant mixture into a single exothermic catalytic reaction channel of a catalytic reactor, the exothermic catalytic reaction channel having an oxidation catalyst deposited therein;

simultaneously passing a second fuel/oxidant mixture into the cooling conduits of the catalytic reactor, the conduits passing through the exothermic catalytic reaction channel; and combining the cooling conduit effluent and reaction channel effluent.

22. The method of claim 21 wherein said first fuel/oxidant mixture and said second fuel/oxidant mixture are from the same source, and the first step of the method is splitting a fuel/oxidant mixture into a first and second fuel/oxidant mixture.

* * * * *

UNITED STATES PATENT AND TRADEMARK OFFICE

CERTIFICATE OF CORRECTION

PATENT NO. : 6,174,159 B1
DATED : January 16, 2001
INVENTOR(S) : Smith et al.

It is certified that error appears in the above-identified patent and that said Letters Patent is hereby corrected as shown below:

On the Title Page, in the Inventors Section:
Delete "Hasan Ulkarim" and substitute --Md. Hasan Ul Karim--.

In the Summary of the Invention:
Column 4,
Line 41: After "channel", insert --may--.

Signed and Sealed this

Tenth Day of July, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,174,159 B1
DATED : January 16, 2001
INVENTOR(S) : Smith et al.

It is certified that error appears in the above-identified patent and that said Letters Patent is hereby corrected as shown below:

Drawings,
Fig. 6:
Replace "70a" with -- 71a --
Replace "71a" with -- 70a --

Signed and Sealed this

Nineteenth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,174,159 B1
DATED : January 16, 2001
INVENTOR(S) : Smith et al.

It is certified that error appears in the above-identified patent and that said Letters Patent is hereby corrected as shown below:

Column 12,
Line 20, replace “second” with -- first --.

Column 13,
Line 62, replace “second” with -- first --.

Column 14,
Line 20, replace “second” with -- first --.

Signed and Sealed this

Eighth Day of April, 2003

JAMES E. ROGAN
*Director of the United States Patent and Trademark Office*